US005651194A

United States Patent [19]

Hayashi

[11] Patent Number: 5,651,194

[45] Date of Patent: Jul. 29, 1997

[54] APPARATUS AND METHOD FOR CONTROLLING REVERSIBLE DRYER

[75] Inventor: Kinya Hayashi, Gifu-ken, Japan

[73] Assignee: Kabushiki Kaisha Toshiba, Kawasaki, Japan

[21] Appl. No.: 428,620

[22] Filed: Apr. 25, 1995

[30] Foreign Application Priority Data

Apr. 26, 1994 [JP] Japan ..... 6-088624

[51] Int. Cl.[6] ..... F26B 19/00

[52] U.S. Cl. ..... 34/550; 34/562; 34/572; 34/574

[58] Field of Search ..... 34/550, 562, 572, 34/574

[56] References Cited

U.S. PATENT DOCUMENTS

| | | | |
|---|---|---|---|
| 3,309,783 | 3/1967 | Worst | 34/48 |
| 3,507,052 | 4/1970 | Robandt | 34/12 |
| 4,738,034 | 4/1988 | Muramatsu et al. | 34/43 |

FOREIGN PATENT DOCUMENTS

| | | |
|---|---|---|
| 1062258 | 3/1967 | United Kingdom . |
| 2265700 | 10/1993 | United Kingdom . |

*Primary Examiner*—Henry A. Bennett
*Assistant Examiner*—Dinnatia Doster
*Attorney, Agent, or Firm*—Cushman Darby & Cushman IP Group of Pillsbury Madison & Sutro LLP

[57] ABSTRACT

A dryer and a method for controlling a dryer for drying items in a rotating drum by supplying hot air therein. In the rotating drum, electrodes are provided in a position at which the items in the rotating drum enable to come into contact with the items. A degree of dryness of the items is detected in accordance with the current passing through the electrodes. When the detected degree of dryness reaches a predetermined level, an untangling operation is carried out. In the untangling operation, a rotation of the rotating drum is controlled in order to untangle a tangled or wrapped state of the items. The drying operation of the dryer is ended in accordance with the detected degree of dryness. The untangling operation can include a forward rotation of the drum followed by stopping the drum. It can also include rotating the drum in a forward direction, then rotating it in a reverse direction and then stopping the drum.

17 Claims, 4 Drawing Sheets

9
9a
26
10b
4
10a
18a
7
10
8a
14
1
8
14a
18
13a
2
4a
G
19
6c
3
6a
6b
5
20
24
G
12
21
23
13a
F
29
13
14b
F
16a
17
22
8a
G
F
11
15a
15

APPARATUS AND METHOD FOR CONTROLLING REVERSIBLE DRYER

BACKGROUND OF THE INVENTION

1. Field of the Invention

The present invention relates to a dryer for drying items in a rotating drum and to a method of controlling a dryer.

2. Description of Related Art

Rotating drum dryers are now well known. Items to be dried, such as clothing, sheets, etc. are loaded into a rotatable drum. The drum is rotated and hot air is forced into the drum. The hot air is generated by a hot air generation system generally including a heater and a fan. During the drying operation, the rotating drum is rotated by a motor.

A conventional dryer has an exhaust temperature sensor for detecting the temperature of air being exhausted from the rotating drum. The detected temperature is used to determine a drying operation time period. The dryer detects the exhaust temperature at the beginning of a drying operation and then again some time later. Based on the temperatures detected, there is determined a rate of increase of exhaust temperature. The drying operation time period is determined in accordance with the rate of increase in exhaust temperature. For example, if the exhaust temperature increases slowly, the drying operation time period is made longer. However, if the exhaust temperature increases rapidly, the drying operation time period is shortened.

However, such a method of controlling the time period is inadequate. When clothes are washed in hot water immediately before drying and are then immediately put into the rotating drum they are still warm from the wash. The exhaust temperature will rise faster than it would otherwise do when the clothes are not already warm from a hot water wash. The warm clothing "fools" such a system into making the drying operation time period too short.

Another known dryer has a dryness detecting device for detecting the degree of dryness of items being dried in the rotating drum. The dryer also has an amount detecting device for detecting the amount, or weight, of the items being dried. The drying operation time period is determined in accordance with the detected degree of dryness and/or amount of items. This type of dryer usually ends its drying operation when the degree of dryness reaches a predetermined level. Such dryers are described in the U.S. Pat. No. 4,738,034. The dryness detecting device and the amount detecting device described in U.S. Pat. No. 4,738,034 commonly use detection electrodes. These electrodes are arranged to face the interior of the rotating drum so that they can come into contact with clothes in the rotating drum being dried. The dryness detecting device includes a dryness detecting circuit for detecting a degree of dryness based on the electrical resistance of the clothes coming into contact with the electrodes while the drum is rotating. The amount detecting device has an amount detecting circuit for detecting the amount of clothes based on the frequency with which clothes in the drum come into contact with the electrodes. The dryer described in the U.S. Pat. No. 4,738,034 determines the end of the drying operation based on the degree of dryness detected by the dryness detecting device and/or the amount of clothes detected by the amount detecting device.

Although the known dryers described above perform adequately under ideal conditions, they do not function properly when drying large items, such as bathrobes, sheets, etc. particularly when they are mixed with regular items of clothing. The regular items of clothing often become tangled with the large items or wrapped by them. When such tangles occur, the outer parts of the items receive a good supply of hot air and dry quickly. In particular, clothes positioned close to the hot air supply port receive concentrated hot air and dry quickly. The outer parts of the clothes in the tangled or wrapped state make contact with the electrodes. Therefore, the electrodes detect a high degree of dryness and the dryer ends the drying operation prematurely. However, the inner parts of clothes that are tangled do not receive much hot air flow.

SUMMARY OF THE INVENTION

It is an object of the invention to provide an improved dryer that more accurately determines the degree of dryness of items being dried and therefore more accurately determines the required time period for drying.

It is another object of the invention to provide an arrangement for determining the correct drying time even when clothing items are tangled.

It is a further object of the invention to provide an arrangement that causes tangled items of clothing to become untangled automatically during drying.

To achieve the above objects, the present invention provides an improved dryer and method for controlling a dryer. According to the invention, drying is carried out until a desired degree of dryness has been achieved. However, when the desired degree of dryness has been indicated, it is not assumed that the drying is finished. Rather, it is recognized that indication of desired degree of dryness may be prematurely indicated due to a tangled or wrapped state of the items being dried. Therefore, the dryer carries out one or more untangling operations. Drying then continues until the untangling has been carried out repeatedly and the desired degree of drying has been achieved.

Electrodes are provided in the rotating drum, positioned so that items of clothing being dried will come into contact with them. A voltage is applied to the electrodes and current flowing through them is measured. From the current measurement, a degree of dryness of the items is determined. When the degree of dryness reaches a predetermined level, an untangling operation is carried out. In the untangling operation, rotation of the rotating drum is controlled in a predetermined manner so as to untangle any tangled or wrapped items of clothing. In one embodiment, this untangling operation comprises operating the drum in a reverse direction. In an alternative embodiment, this untangling operation comprises stopping the drum and restarting rotation. The untangling operation may be repeated as necessary until it is determined that a desired degree of dryness has actually been achieved and is not indicated prematurely due to tangled clothing that are only dried on the outside parts. When it is determined that the items of clothing are not tangled and that drying has been carried out to the desired degree of dryness, the drying operation is fully stopped.

BRIEF DESCRIPTION OF THE DRAWINGS

In the accompanying drawings.

DETAILED DESCRIPTION OF PREFERRED EMBODIMENT

Figure 1:
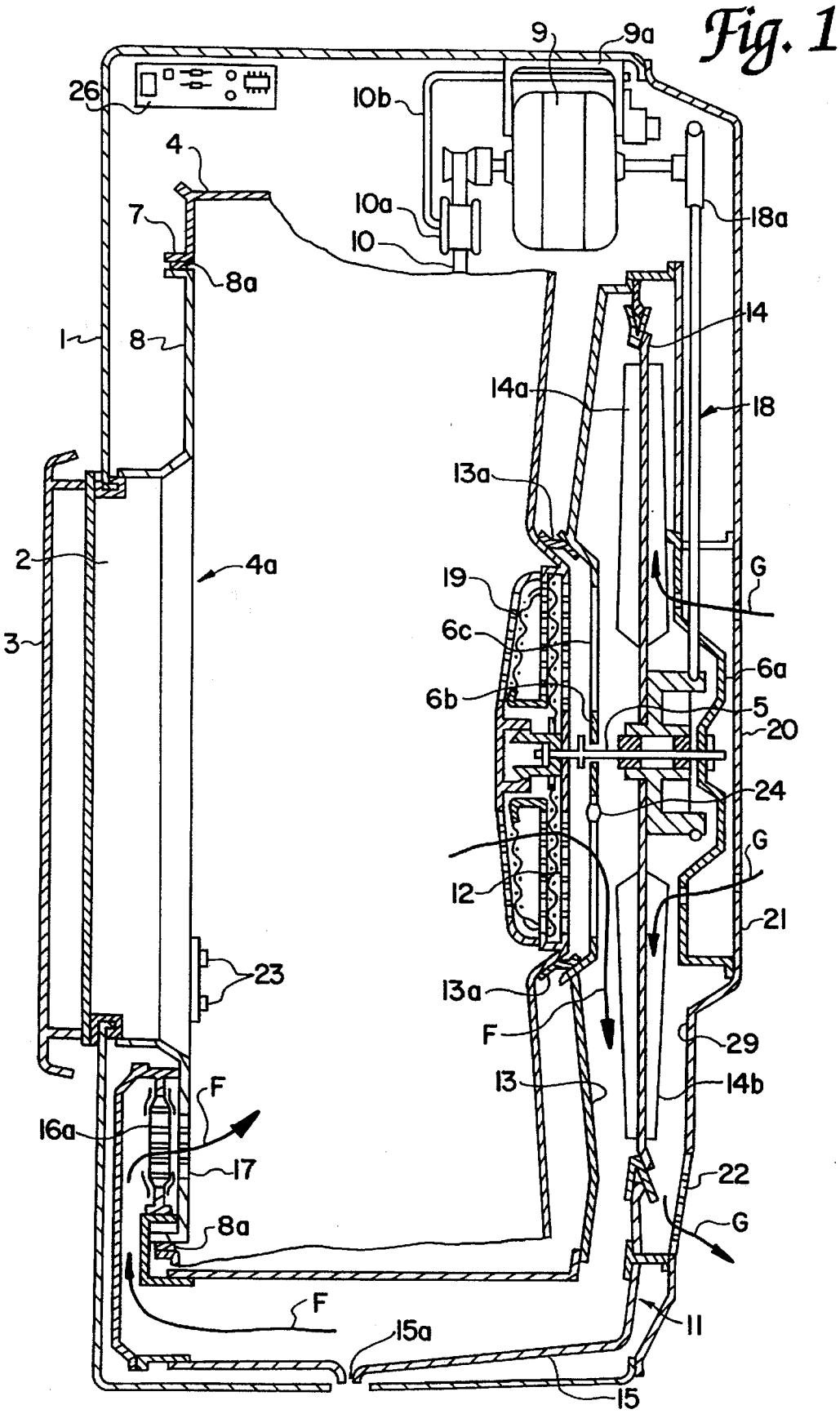
FIG. 1 is a schematic vertical cross-section view of a dryer according to the invention.

A first embodiment of the present invention will be explained with reference to FIGS. 1 to 3. FIG. 1 is a vertical cross section of the entire dryer. Outer case 1 has a loading/unloading port 2 for easily accessing the dryer from the front center thereof. Opening/closing door 3 is mounted in hinged fashion to open and close loading/unloading port 2. Rotating drum 4 is installed in outer case 1 and supported by a shaft 5. Shaft 5 is rotatably supported by rear supporting plate 6*a* provided on the rear part of outer case 1 and passing through middle plate 6*b* placed in the outer case 1. A cylindrical flange section 7 formed on the periphery of a large diameter opening 4*a* on the front part of rotating drum 4 is rotatably supported on a drum support 8 provided on the front part of outer case 1 by a slip ring 8*a*. Rotating drum 4 is driven in rotation via belt 10 by motor 9 which is fixed with the upper part of outer case 1 via motor support 9*a*. Belt 10 is tensioned by tension pulley 10*a* which is pushed by a tension spring 10*b*. Motor 9 can be controlled to drive in both forward and reverse directions. Therefore, rotating drum 4 can rotate in both forward and reverse directions.

A hot air supply system 11 for supplying hot air to inside of rotating drum 4 is installed in the outer case 1. Air passage port 12 through which air passes, is formed by a large number of small holes at the center rear portion of rotating drum 4. Inner fan casing 13, which supports middle plate 6*b* having air outlet opening 6*c*, is located between rotating drum 4 and outer case 1, and linked to air passage port 12. Double-bladed fan 14 has two blades 14*a*, 14*b*, wherein inside blade 14*a* is in inner fan casing 13 and outside blade 14*b* is in outer fan casing 29. Outer fan casing 29 and inner fan casing 13 are separated by blades 14*a*, 14*b*. Double-bladed fan 14, working a hot air circulator and dehumidifier, is arranged coaxially on shaft 5. Duct 15 for introducing air between inner fan casing 13 and the front of rotating drum 4 is provided under rotating drum 4. Drain port 15*a* for discharging water from the dryer is provided at the bottom center of duct 15. Two positive temperature coefficient thermistor (PTC) heaters 16*a* and 16*b* (only one PTC heater 16*a* is shown in FIG. 1) is positioned at a connecting portion between duct 15 and rotating drum 4. These PTC heaters 16*a*, 16*b* are mounted on drum support 8 at the front end, or the down stream side, of duct 15. Hot air blower port 17 formed by a large number of small holes in drum support 8 is provided at the rear of PTC heaters 16*a*, 16*b*. Ring seal 13*a* for preventing air from leaking outside of rotating drum 4 and duct 15 is attached to the inner fan casing 13. Fan belt 18 between fan belt pulley 18*a* which is directly fixed with the shaft 5 of motor 9 and double-bladed fan 14 transmits the rotational force of the motor to double-bladed fan 14. Thus, motor 9 rotates both rotating drum 4 and double-bladed fan 14 at the same time. Filter 19 is arranged in the air passage port 12 of hot air supply system 11. Filter 19 covers air passage port 12 from inside of drum 4. Back plate 20, arranged on the rear face of outer case 1, has an external air intake port 21, which comprises a large number of small holes, at its central portion. External air intake port 21 sucks in external air using outside blade 14*b* of double-bladed fan 14 in outer case 1. Air exhausts from louvered external air return port 22 provided in the rear lower part of outer case 1.

A pair of electrodes 23 are mounted on the lower part of drum support 8 having an insulating gap between them. Electrodes 23 face the inside of rotating drum 4. Thus, when the items in rotating drum 4 touch electrodes 23 the electrical resistance between electrodes 23 becomes lower, i.e. current flow through them increases. The resistance between electrodes 23 is directly related to the water content of the items coming into contact with electrodes 23. Therefore, it is possible to detect the degree of dryness D of the items in accordance with the resistance between electrodes 23. This type of dryness detector for the dryer is explained in U.S. Pat. No. 4,738,034, the subject matter of which is incorporated herein by reference as if fully set forth.

Electrodes 23 are also used to determine the amount of items in the drum being dried. As the drum turns, items drying inside come into contact with electrodes 23 periodically. The more items there are in the drum, the more often there are contacts between the items and electrodes 23. It is possible to note the frequency of low resistances and determine therefrom the amount of items in the drum. This type of sensing arrangement is also described in U.S. Pat. No. 4,738,034.

Temperature sensor 24 for detecting the temperature of the air flowing out from inside rotating drum 4 through air passage port 12 is fixed to middle plate 6*b* facing air outlet opening 6*c*. Circuit board 26, on which are packaged electric components, is arranged inside the top of outer case 1. Circuit board 26 includes a control circuit shown in FIG. 2 and its peripheral circuits.

Figure 2:
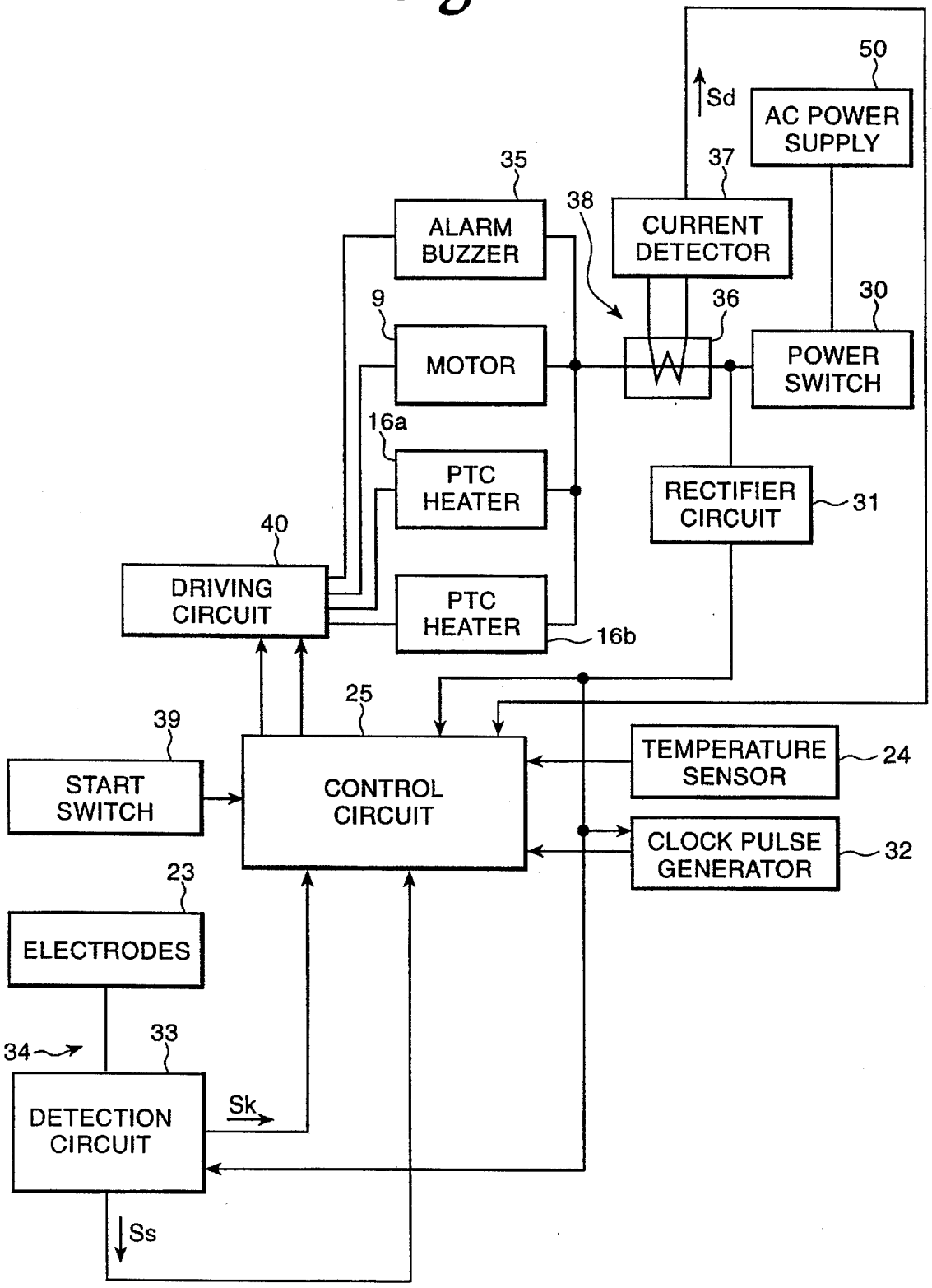
FIG. 2 is a block diagram of an electrical circuit of the dryer.

FIG. 2 is a functional block diagram explaining control of the dryer. Control circuit 25 is mounted on circuit board 26 shown in FIG. 1. Control circuit 25 is most advantageously implemented by a microcomputer and its peripheral circuits. However, a hard-wired circuit could also be used. Control circuit 25 has many functions. Among its many functions, control circuit 25 functions as an initial drying operation period setting device for setting a completion detecting start time to allow detection of the dryness of items in order to finish the drying operation. It also functions as a controller for controlling the drying operation, and a correction device for correcting the initial drying operation period. A power switch 30, AC power supply 50 and a rectifier circuit 31 provide power to control circuit 25 and various peripherals, such as a clock pulse generator 32 and a detection circuit 33. Clock pulse generator 32 provides a clock signal to control circuit 25. Detection circuit 33 is coupled to electrodes 23 in the drum. Detection circuit 33 cooperating with electrodes 23 constitutes the dryness detector and a part of the amount of the items detector. The resistance between electrodes 23, which indicates the degree of dryness D of the items, is converted to a voltage signal. This voltage signal is output as degree of dryness signal SK from detection circuit 33 which is input to control circuit 25. Detection circuit 33 generates a contact signal Ss every time the items in rotating drum 4 make contact with electrodes 23. Contact signal Ss is also input to control circuit 25. Control circuit 25 supplies signals to a driver 40 which in turn drives an alarm buzzer 35, motor 9, PTC heater 16*a* and PTC heater 16*b*.

A current transformer 36 generates a current in response to the current of the conducting paths from power switch 30 to motor 9, PTC heaters 16*a*, 16*b* and alarm buzzer 35. The current generated by current transformer 36 is supplied to a current detector 37. Current detector 37 generates current value signal Sd which indicates the current I generated by current transformer 36. Current value signal Sd is input to control circuit 25.

During the drying operation, motor 9 and PTC heaters 16*a*, 16*b* are all energized, and alarm buzzer 35 is not energized. The current flowing through motor 9 is almost constant during the drying operation. Therefore, a change of current generated by current transformer 36 depends on only PTC heaters 16*a*, 16*b*.

The changing of current I therefore constitutes an indication of air circulation through rotating drum 4. When there is hardly any lint on filter 19, there is substantially no resistance to air flow through filter 19. Thus, the hot air circulation in rotating drum 4 is good, and the current I is in its normal range of 12.5 to 13.5 (A). However, if lint accumulates on filter 19, it will block air passing through filter 19, thereby decreasing air circulation. The amount of air passing through PTC heaters 16*a*, 16*b* also decreases. Thus, the temperature of PTC heaters 16*a*, 16*b* increases and the current I of PTC heaters 16*a*, 16*b* decreases to under 12.5 (A) because of the character of PTC heaters 16*a*, 16*b*. Accordingly, control circuit 25 can also detect the air circulating condition based on the current flowing through PTC heaters 16*a*, 16*b*.

It is also possible to arrange the current transformer 36 to measure only the current flowing through PTC heaters 16*a*, 16*b*. In this case, control circuit 25 can detect more accurately the condition of air circulation. The condition of air circulation is used to correct the ending time of the drying operation which is described later.

Figure 3:
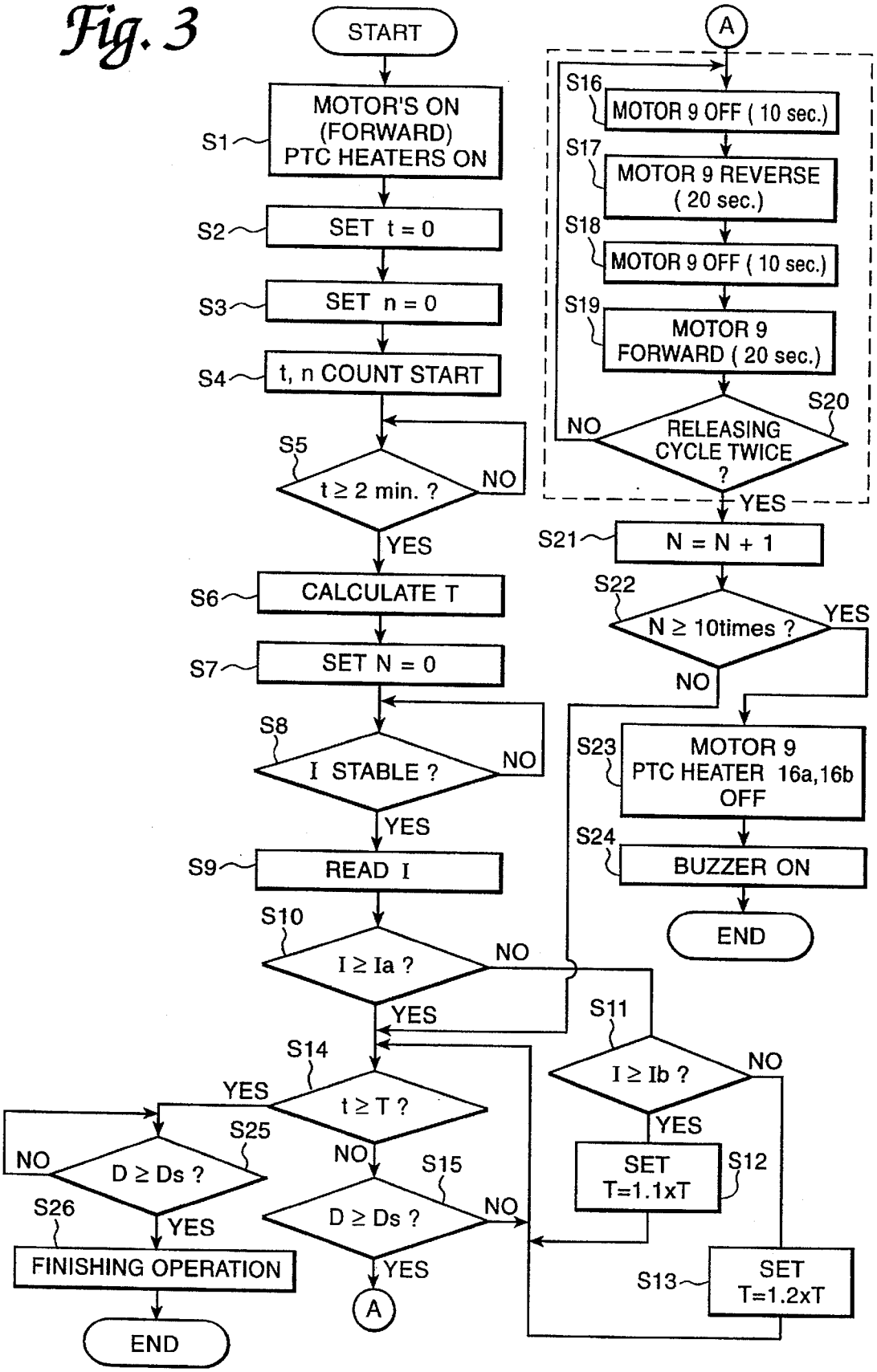
FIG. 3 is a flowchart showing a control operation of a control circuit of the dryer.

Referring now to FIG. 3, the operation of control circuit 25 will be explained. When power switch 30 is turned on, control circuit 25 executes its operations. When a "Start signal" is input by operating start switch 39 (see FIG. 2), control circuit 25 starts the drying operation. In the drying operation, control circuit 25 turns on PTC heaters 16*a*, 16*b*, and supplies an electric power to motor 5 to rotate the motor in the forward direction via driving circuit 40 (step S1). Thus, rotating drum 4 and double-bladed fan 14 rotate during the drying operation. Air blown by inside blade 14*a* of double-blade fan 14 passes through inner fan casing 13, duct 15 and PTC heaters 16*a*, 16*b*. Then, the hot air heated at PTC heaters 16*a*, 16*b*, enters into the inside of rotating drum 4 as shown by arrows F in FIG. 1. An air circulation path from inside rotating drum 4 to inner fan casing 13 via filter 19 and air passage port 12 is formed by inside blade 14*a*. The hot air dries the items in rotating drum 4.

At the same time, outside blade 14*b* draws external air into outer fan casing 29 from external air intake port 21. The air cools outside blade 14*b*, then is exhausted from external air return port 22 as shown by arrows G in FIG. 1. Outside blade 14*b* and inside blade 14*a* are made of the same high thermal conductive material, for example steel. Therefore, inside blade 14*a* is cooled by outside blade 14*b* cooled by the external air. As a result, the moisture in the hot air circulating in rotating drum 4 forms dew by condensing on the front faces of inside blade 14*a*. The dew is thrown outside from rotating inside blade 14*a* by centrifugal force, and drops at the bottom of duct 15. Then, the dew is drained to outside from drain port 15*a*. The moisture from the items in rotating drum 4 is discharged outside as water. The humid air in rotating drum 4 is not discharged outside by this configuration. Therefore, if the dryer is installed in the room, the drying operation does not cause the room to become uncomfortable with high humidity.

After the drying operation starts in step S1, the drying operation time t is set to "0" (step S2), and the number of signals n of contact signal Ss is also set to "0" (step S3). Then, at step S4 there is begun a count of the drying operation time t and the number of signals n. If the contact signal Ss exists at specific times, the number of signals n is incremented. However, if the contact signal Ss does not exist at specific times, the number of signals n is not changed (not incremented). In this embodiment, the specific times occur at 8 msec intervals. However, the timing can be made longer or shorter. In step S5, inquiry is made whether the drying operation time t reaches 2 minutes. If the drying operation time t does not reach 2 minutes, the counting of the drying operation time t and the number of signals n continues. However, if drying operation time t reaches 2 minutes, the counting of the time t and the number of signals n stops. Then, an initial drying operation period T which means a minimum time period of the drying operation is calculated based on the counted number of signals n during 2 minutes (step S6). The existence of the contact signal Ss is detected at 8 msec intervals for 2 minutes, so the detection of the existence of the contact signal Ss totals 15000 times. The number of signals n indicates a frequency (n/15000) with which items in rotating drum 4 come into contact with electrodes 23. The amount of items is proportional to the number of contacts, or the number of signals n. Therefore, the amount of items can be detected by this number of signals n. The calculation of the initial drying operation period T is based on the number of signals n multiplied by a constant k, because the greater the amount of items, the longer the dry time required. The constant k is decided based on the capacity of the dryer. For example, in a dryer with rated capacity 4.5 kg, k=0.01 to 0.015 (minute/number of signals), while in a dryer with rated capacity 4.0 kg, k=0.008 to 0.013 (minute/number of signals). Of course, if the detecting intervals and/or the detecting time period is changed, the constant k should be changed. If the counted number of signals n=10,500 and k=0.012, the initial drying operation period T=126 (minutes).

The initial drying operation period T is calculated by the equation T=k*n. However, as an alternative, various initial drying operation periods could be stored as a look up table in memory. Various drying times could be associated with values of n. Then, as the number of signals n is determined, the initial drying operation period T could be looked up in the table. Also, as an alternative a different kind of amount detection device could be used, for example, a weight detector could be used.

In step S7, the count N which indicates the number of specified degree of dryness detections for initial drying operation period T is set at "0" (reset). In step S8, inquiry is made whether current value signal Sd which indicates current I from current detector 37 has been stable. If it has been stable, the current I is read. If it has not been stable, operation flow returns to step S8. Thus, the operation flow repeats step S8 until current value signal Sd indicates a stable value. After reading current I (step S9), inquiry is made in step S10 whether current I is more than a first reference current Ia. First reference current Ia is set at 12 (A) which is slightly less than the current that flows when hot air circulation in rotating drum 4 is good. If detected current I is not more than first reference current Ia, it indicates that air flow in rotating drum 4 is lower than normal air flow. An inquiry is made whether detected current I is more than second reference current Ib, for example, 11 (A) (step S11). If detected current I is more than second reference current Ib, that is detecting current I is between 11 (A) and 12 (A), it indicates the air flow in rotating drum 4 is slightly decreased. In this case, initial drying operation period T is adjusted or corrected by setting T to **1.1*T (step S12). In the case when initial drying operation period T set in Step S6 is, for instance, "126 minutes", initial drying operation period T is corrected to 126*1.1=138.6 (minutes). If detected current I is not more than second reference current Ib, it indicates the air flow in rotating drum 4 is extremely decreased. In this case, initial drying operation period T is adjusted to 1.2*T (step S13), that is initial drying operation period T is corrected to 126*1.2=151.2 (minutes). Under normal conditions, current I is more than 10 (A). On the other hand, in step S10, if current I is more than first reference current Ia, it indicates that the hot air circulation in rotating drum 4 is good, the operation flow goes to step S14 without correcting initial drying operation period T. Accordingly, when the volume of the hot air supplied to rotating drum 4** is decreased, the initial drying operation period T, which is one important factor to finish the dry operation, may be extended. Thus, the time period of drying operation is extended.

In step S14, inquiry is made whether drying operation time t has reached initial drying operation period T. If drying operation time t has not completed the initial drying operation period T, another inquiry is made as to whether the degree of dryness D is more than the predetermined degree of dryness Ds. In other words, it is determined whether the predetermined degree of dryness Ds is detected, based on the degree of dryness signal Sk from detection circuit 33 (step S15). If the predetermined degree of dryness Ds is detected in step S15, forward and reverse rotation is executed twice. This is known as an "untangling operation", as shown in steps S16 to S20. Before drying operation time t reaches the end of the initial drying operation period T, the items have not yet dried in the normal condition. Therefore, the detection of the predetermined degree of dryness Ds during this period means an occurrence of tangled state or wrapped state of the items in rotating drum 4. Therefore, the untangling operation as shown in steps S16 to S20 is executed to untangle the tangled or wrapped items. In step S16, motor 9 is switched OFF for 10 seconds and the motor stops. Then, current is switched ON so that motor 9 rotates in reverse for 20 seconds (step S17). After that, motor 9 is stopped again for 10 seconds (step S18), then current is switched ON so that motor rotates forward for 20 seconds (step S19). The number of times the untangling cycle (stopping, reverse rotation, stopping and forward rotation of motor 9) is carried out is judged in step S20. The untangling cycle is executed twice.

After the untangling operation is carried out, count N of the number of times of the untangling operation increments. Count N indicates the number of times the predetermined degree of dryness Ds has been detected while drying operation time t does not exceed initial drying operation period T. Then, inquiry is made whether count N has reached 10 times (step S22). If count N has reached 10 times, the drying operation is suspended by switching OFF motor 9 and PTC heaters **16*a*, 16*b* (step S23). Then, alarm buzzer 35 is sounded to warn of an abnormal condition (step S24). Normally, tangled or wrapped items in rotating drum 4** will become untangled or unwrapped during a untangling operation and it is unlikely that the number of such untangling operations would exceed ten. Therefore, when count N exceeds 10 times, the drying operation is stopped and the alarm buzzer warning is sounded.

If count N has not reached ten in step S22, operation flow returns to step S14. A comparison is carried out at step S15 between the detected degree of dryness D and predetermined degree of dryness Ds. If, based on the judgment of step 15 the untangling operation is needed, it is repeated by carrying out steps S16 to S22. Control again returns to step S14. If drying operation time t reaches initial drying operation period T in step S14, inquiry is made as to whether the detected degree of dryness D is equal to or greater than the predetermined degree of dryness Ds (step S25). The inquiry of step S25 is the same as that made at step S15, however step S15 relates to the detection of the tangled or wrapped state of the items during the drying operation, while step S25 relates to a detection of ending of the drying operation. If detected degree of dryness D is more than the predetermined degree of dryness Ds in step S25, the drying operation is finished and a finishing operation to cool the items executes (step S26).

The process of the finishing operation differs depending on whether the items are thick or thin based on user input to control circuit 25 before the drying operation. If the user selects the thick items mode, PTC heaters **16*a*, 16*b* are switched ON for 40 minutes and motor 9 is switched ON for 50 minutes after the detection of the predetermined degree of dryness Ds, that is the items are cooled by the air for the last 10 minutes. But, if the user selects the thin items mode, PTC heaters 16*a*, 16*b* are switched ON for 20 minutes and motor 9 is switched ON for 30 minutes after the detection, that is, the items are also cooled for the last 10 minutes. By this finishing operation, the items in rotating drum 4** will achieve a completely dry and cool state.

In the above described embodiment, the untangling operation includes two untangling cycles, however the number of cycles may be 1 or 3 or more.

Figure 4:
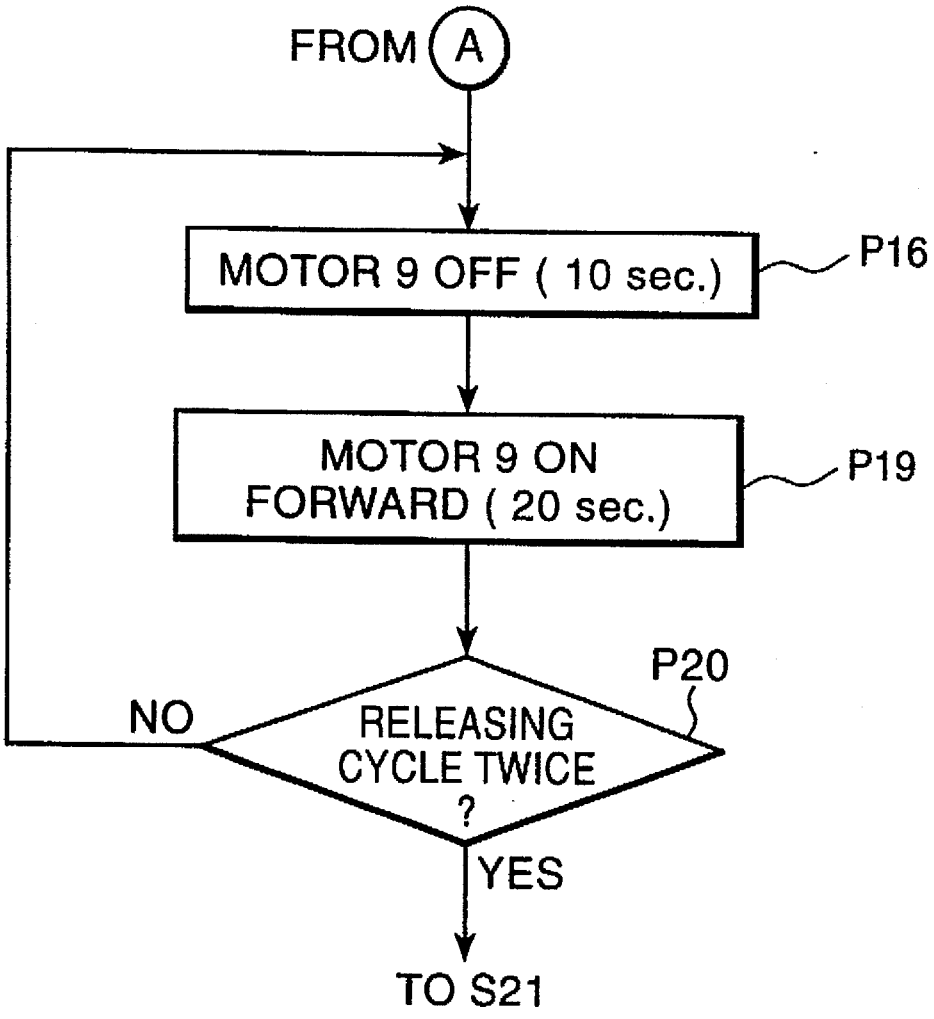
FIG. 4 is a flowchart indicating steps related to a second method of controlling. Only steps different from those of FIG. 3 are shown.

Referring now to FIG. 4, a second embodiment will be explained. The difference between the first and second embodiments is only the process of the untangling operation. In the second embodiment, a untangling cycle of the untangling operation consists of stopping rotating drum 4 and then rotating it in the forward direction. Accordingly, the second embodiment does not require a motor that can rotate in both forward and reverse directions. Such an arrangement is less expensive. All other components of the second embodiment are the same as those of the first embodiment. For this embodiment, the steps of FIG. 3 that are within a dashed line (steps S16 to S20) are replaced by steps P16, P19 and P20 shown in FIG. 4.

In the untangling operation, motor 9 is switched OFF for 10 seconds (step P16), then motor 9 rotates forward for 20 seconds (step P19). This untangling cycle is carried out twice according to step P20. Accordingly, in the second embodiment, motor 9 and rotating drum 4 intermittently operate when the predetermined degree of dryness Ds is detected. The state of agitation of the items in rotating drum 4 varies through the variation of the centrifugal force of rotating drum 4 on the items by the untangling operation. Therefore, even through motor 9 is not operated in reverse, a tangled state or wrapped state of items can be effectively untangled.

Many changes and modifications in the above described embodiment can be carried out without departing from the scope of general inventive concept as defined by the appended claims and their equivalents.

What is claimed is:

1. A dryer, comprising:

a rotatable drum;

means for rotating the drum in both forward and reverse directions;

means for causing, during a drying operation, heated air to flow through the drum;

electrodes provided at a position at which the items drying in the rotating drum come into contact therewith;

dryness detecting means for detecting the degree of dryness of the items in accordance with a current passing through the electrodes;

amount detecting means for detecting an amount of items being dried in the drum based on a frequency of contacts of the items with the electrodes;

untangling time setting means for setting an untangling time in accordance with the detected amount of the items;

untangling means which is operative during the untangling time for driving the rotating drum in reverse for a predetermined time when the detected degree of dryness reaches a predetermined level; and ending means for ending the drying operation based on the detected degree of dryness.

2. A dryer, comprising:

a rotatable drum;

means for rotating the drum in at least a forward direction;

means for causing, during a drying operation, heated air to flow through the drum;

electrodes provided at a position at which the items drying in the rotating drum come into contact therewith;

dryness detecting means for detecting the degree of dryness of the items in accordance with a current passing through the electrodes;

amount detecting means for detecting an amount of items being dried in the drum based on a frequency of contacts of the items with the electrodes;

untangling time setting means for setting an untangling time in accordance with the detected amount of the items;

untangling means which is operative during the untangling time for stopping the rotation of the rotating drum for a predetermined time when the detected degree of dryness reaches a predetermined level; and ending means for ending the drying operation based on the detected degree of dryness.

3. A dryer according to claim 1 or 2, wherein the ending means is enabled to end the drying operation after the untangling time has elapsed.

4. A dryer according to claim 1 or 2, further comprising:

a heater; and a fan for blowing an air into the rotating drum passing through the heater.

5. A dryer according to claim 4, wherein the heater is a positive temperature coefficient thermistor (PCT) heater.

6. A dryer according to claim 1 or 2, further comprising:

a current detecting means for detecting the heater current passing through the positive temperature coefficient thermistor heater; and correcting means for correcting the untangling time set by the untangling time setting means in accordance with the detected heater current.

7. A dryer according to claim 1 or 2, further including stopping means for stopping the drying operation when a number of times that the detected degree of dryness reaches the predetermined level reaches a predetermined number before the untangling time has elapsed.

8. A dryer according to claim 1 or 2, further comprising:

a malfunction indicator; and means for causing the indicator to indicate a malfunction when a number of times that the detected degree of dryness reaches the predetermined level reaches a predetermined number before the untangling time has elapsed.

9. A dryer, comprising:

a rotatable drum;

means for rotating the drum in both forward and reverse directions;

means for causing, during a drying operation, heated air to flow through the drum;

electrodes provided at a position at which the items drying in the rotating drum come into contact therewith;

dryness detecting means for detecting the degree of dryness of the items in accordance with a current passing through the electrodes;

amount detecting means for detecting an amount of items being dried in the drum based on a frequency of contacts of the items with the electrodes;

untangling time setting means for setting an untangling time in accordance with the detected amount of the items;

untangling means which is operative during the untangling time for controlling the rotation of the rotating drum to untangle the tangled items during the drying operation in accordance with the detected degree of dryness; and ending means which is operative after the untangling time has elapsed for ending the drying operation in accordance with the detected degree of dryness.

10. A method for controlling a dryer which has a drum that can be rotated in both forward and reverse directions, a hot air supply for causing hot air to flow through the drum to dry items placed therein, electrodes in the drum positioned so that the items being dried will come into contact with the electrodes, and means for applying power to the electrodes and measuring current flowing through the electrodes, the method comprising the steps of:

detecting the degree of dryness of the items in accordance with a measured current passing through the electrodes;

detecting an amount of the items in accordance with a frequency of the contacts of the items with the electrodes; and setting an untangling time in accordance with the detected amount of the items;

rotating the drum in reverse during the untangling time for a predetermined time when the detected degree of dryness reaches a predetermined level; and ending the drying operation in accordance with the detected degree of dryness.

11. A method for controlling a dryer which has a rotatable drum, a hot air supply for causing hot air to flow through the drum to dry items placed therein, electrodes in the drum positioned so that the items being dried will come into contact with the electrodes, and means for applying power to the electrodes and measuring current flowing through the electrodes, the method comprising the steps of:

detecting the degree of dryness of the items in accordance with a current level passing through electrodes;

detecting an amount of the items in accordance with a frequency of the contacts of the items with the electrodes; and setting an untangling time in accordance with the detected amount of the items;

stopping the rotation of the rotating drum during the untangling time for a predetermined time when the detected degree of dryness reaches a predetermined level; and ending the drying operation in accordance with the detected degree of dryness.

12. A method according to claim 10 or 11, wherein the ending step is enabled to end the drying operation after the untangling time has elapsed.

13. A method according to claim 10 or 11, wherein the hot air supply comprises a positive temperature coefficient thermistor heater and a fan for blowing an air into the drum passing through the positive temperature coefficient thermistor heater.

14. A method according to claim 13, further comprising the steps of:

detecting the heater current flowing through the positive temperature coefficient thermistor heater; and correcting the untangling time set by the untangling step in accordance with the detected heater current.

15. A method according to claim 10 or 11, further comprising the step of stopping the drying operation when a number of times that the detected degree of dryness reaches the predetermined level reaches a predetermined number before the untangling time has elapsed.

16. A method according to claim 10 or 11, further comprising the step of indicating an abnormal state when a number of times that reaches the detected degree of dryness reaches the predetermined level reaches a predetermined number before the untangling time has elapsed.

17. A method for controlling a dryer which has a rotatable drum, a hot air supply for causing hot air to flow through the drum to dry items placed therein, electrodes in the drum positioned so that the items being dried will come into contact with the electrodes, and means for applying power to the electrodes and measuring current flowing through the electrodes, the method comprising the steps of:

detecting the degree of dryness of the items in accordance with a current level flowing through electrodes;

detecting an amount of the items in accordance with a frequency of the contacts of the items with the electrodes; and setting an untangling time in accordance with the detected amount of the items;

controlling the rotation of the rotating drum during the untangling time to untangle tangled items in the rotating drum in accordance with the detected degree of dryness; and ending the drying operation after the untangling time has elapsed in accordance with the detected degree of dryness.

* * * * *